US009806482B2

(12) United States Patent
Angerpointner et al.

(10) Patent No.: US 9,806,482 B2
(45) Date of Patent: Oct. 31, 2017

(54) SLIP RING AND SLIP RING UNIT HAVING A SLIP RING

(71) Applicant: LTN Servotechnik GmbH, Otterfing (DE)

(72) Inventors: Ludwig Angerpointner, München (DE); Peter Autenzeller, Feldkirchen-Westerham (DE)

(73) Assignee: LTN SERVOTECHNIK GMBH, Otterfing (DE)

( * ) Notice: Subject to any disclaimer, the term of this patent is extended or adjusted under 35 U.S.C. 154(b) by 0 days.

(21) Appl. No.: 15/211,350

(22) Filed: Jul. 15, 2016

(65) Prior Publication Data

US 2017/0018900 A1 Jan. 19, 2017

(30) Foreign Application Priority Data

Jul. 15, 2015 (EP) ..... 15176837

(51) Int. Cl.
*H01R 39/00* (2006.01)
*H01R 39/08* (2006.01)

(52) U.S. Cl.
CPC ..... *H01R 39/08* (2013.01)

(58) Field of Classification Search
CPC ..... H01R 35/04; H01R 39/64; H01R 39/00; H01R 39/08; H02K 13/006; F05B 2220/7066
USPC ..... 439/11, 13, 20–24, 28; 310/128, 231, 310/232
See application file for complete search history.

(56) References Cited

U.S. PATENT DOCUMENTS

| | | | | |
|---|---|---|---|---|
| 1,339,988 A | | 5/1920 | Steinberger | |
| 2,551,030 A | | 5/1951 | Madden | |
| 2,967,283 A | * | 1/1961 | Medney | C25D 7/04 205/167 |
| 3,095,252 A | * | 6/1963 | Adkins | H01R 39/00 310/231 |
| 3,564,168 A | * | 2/1971 | Bigg | H01R 39/00 200/275 |

(Continued)

FOREIGN PATENT DOCUMENTS

DE 1 796 293 9/1959

*Primary Examiner* — Thanh Tam Le
(74) *Attorney, Agent, or Firm* — Andrews Kurth Kenyon LLP

(57) ABSTRACT

A slip ring includes a dielectric carrier body having a circumferential lateral surface and radially oriented feed-through leads, a first conductive element, and a second conductive element. In a first section, the conductive elements extend in parallel at an axial offset on the lateral surface in the circumferential direction, and in a second section, they extend in the feed-through leads with a radial directional component. The first sections extend in the circumferential direction across a first angular dimension of less than 360°, so that a discontinuity is present along the circumferential direction of the conductive elements in a second angular dimension. The feed-through leads are arranged such that the second angular dimension of the first conductive element is situated at an offset from the second angular dimension of the second conductive element in the circumferential direction, the first and the second conductive elements being electrically connected to each other.

15 Claims, 6 Drawing Sheets

(56) References Cited

U.S. PATENT DOCUMENTS

| | | | | | |
|---|---|---|---|---|---|
| 3,652,971 | A * | 3/1972 | Bugg | H01R 39/00 | 439/10 |
| 3,686,514 | A * | 8/1972 | Dube | H01R 39/00 | 310/232 |
| 4,447,752 | A * | 5/1984 | Boyce | H01R 39/24 | 310/232 |
| 4,870,311 | A * | 9/1989 | Chase | H01R 39/08 | 310/232 |
| 5,224,138 | A | 6/1993 | Hirao et al. | | |
| 5,977,681 | A * | 11/1999 | Retzlaff | H01R 39/64 | 310/219 |
| 6,767,217 | B2 * | 7/2004 | Jacobson | H02K 13/003 | 439/24 |
| 7,481,655 | B2 * | 1/2009 | Horst | H01R 39/64 | 439/24 |
| 8,348,677 | B2 * | 1/2013 | Angerpointner | H01R 39/64 | 439/23 |
| 8,616,897 | B2 * | 12/2013 | Angerpointner | H01R 39/385 | 439/24 |
| 8,899,991 | B2 * | 12/2014 | Ickler | H01R 24/40 | 439/11 |
| 2009/0091208 | A1 | 4/2009 | Yu et al. | | |

* cited by examiner

C - C

SLIP RING AND SLIP RING UNIT HAVING A SLIP RING

CROSS-REFERENCE TO RELATED APPLICATIONS

The present application claims priority to application Ser. No. 15/176,837.1, filed in the European Patent Office on Jul. 15, 2015, which is expressly incorporated herein in its entirety by reference thereto.

FIELD OF THE INVENTION

The present invention relates to a slip ring and to a slip ring unit that includes a slip ring.

BACKGROUND INFORMATION

A slip ring unit normally includes two subassemblies, i.e., a stator and a rotor. The stator frequently includes at least one brush unit, while the rotor usually has a series of slip rings. During operation, brushes of the brush units are in sliding contact with the lateral sides of the rotating slip rings. Such slip-ring units are used in many technical fields for transmitting electrical signals or electric power from a stationary unit to a rotating electrical unit or in the opposite direction.

U.S. Pat. No. 5,224,138 describes a slip ring, which has a cylindrical carrier body made of an insulating material, on whose lateral side a conductor strip is provided.

SUMMARY

Example embodiments of the present invention provide a slip ring for a slip ring unit, which, for example, is suitable for transmitting high frequency currents or signals and at the same time is simple and economical in its production.

According to an example embodiment of the present invention, a slip ring includes a dielectric carrier body having a peripheral lateral surface and radially oriented feed-through leads, which penetrate the lateral surface and the carrier body. Furthermore, the slip ring includes a first and a second conductive element, each conductive element having a first section and a second section. In the first section, the two conductive elements are arranged in parallel at an axial offset and extend in the circumferential direction on the lateral surface. In the second section, the conductive elements extend within the feed-through leads with a radial directional component. The first section extends across a first angular dimension of less than 360° in each case, so that a discontinuity is present in a second angular dimension along the circumferential direction of the conductive elements. Furthermore, the feed-through leads are arranged so that the second angular dimension of the first conductive element is disposed at an offset from the second angular dimension of the second conductive element in the circumferential direction. The first and the second conductive elements are electrically connected to each other. The first and the second conductive element are to be assigned to one and the same track.

The first sections of the two conductive elements thus extend in parallel at an axial offset, e.g., in a circular manner, on the lateral surface in the circumferential direction, while the second sections of the conductive elements, for example, have a straight extension in the feed-through leads with a radial directional component.

The term lateral surface hereinafter is to be interpreted according to the geometric definition for a cylindrical body, the slip ring possibly having a cylindrical, e.g., a hollow-cylindrical, or annular configuration. The lateral surface, for example, is the circumferential outer surface of the slip ring, but the term may also describe the circumferential inner surface in the following description.

More specifically, along a circumferential line of a conductive element, the first angular dimension and the second angular dimension extend over a total of 360°, i.e., across the full circumference.

The term discontinuity hereinafter describes a point along a circumferential line, at which a conductive element does not extend along the carrier body at its outer diameter (provided the conductive elements are mounted on the outer lateral surface) or at its inner diameter (provided the conductive elements are mounted on the inner lateral surface). In particular, the ends of the first section of a conductive element are set apart by a gap or a joint. A discontinuity, for example, may therefore also describe a gap or joint.

The discontinuity thus extends across a sector angle that corresponds to the second angular dimension, which, for example, is calculated using the formula 360° minus the first angular dimension of the first section of the conductive element.

The lateral surface may include a first and a second circumferential groove, the first conductive element being provided in the first groove, and the second conductive element being provided in the second groove.

The slip ring may include a third conductive element which, in a first section, is arranged in parallel with and at an axial offset from the first and second conductive elements on the lateral surface and extends in the circumferential direction. In addition, the third conductive element extends with a radial directional component in a second section in feed-through leads. The first section extends across a first angular dimension of less than 360°, so that a discontinuity is present in a second angular dimension along the circumferential direction of the third conductive element, or along the second angular dimension. Moreover, the feed-through leads are arranged so that the second angular dimension of the third conductive element is disposed at an offset from the second angular dimension of the first and/or the second conductive element in the circumferential direction, the first, the second, and the third conductive elements being electrically connected to each other.

In a similar manner, additional conductive elements may be provided on the carrier body as well, so that, for example, four or more conductive elements may be provided in four or more grooves.

The first angular dimension may extend across at least 270°, across at least 300°, across at least 340°, etc.

As an alternative, the slip ring may also be configured such that multiple conductive elements are provided next to each other along a circumferential line in a circumferential direction, so that multiple discontinuities occur along this circumferential line.

A gap may exist in the circumferential direction on the lateral surface between the feed-through lead of the first conductive element and the feed-through lead of the second conductive element.

The conductive elements may be arranged as individual wires, which, for example, have a cross section of less than 20 $mm^2$, less than 10 $mm^2$, less than 5 $mm^2$, etc.

The wire may have a round cross-section, which may be advantageous especially for transmitting high frequency signals.

The conductive elements with their first and second sections may be arranged in one piece.

The conductive elements may be coated with a noble metal such as gold, for example.

The electrical connection of the conductive elements may be provided radially on the inside in relation to the first section. The conductive elements are provided on the outer circumference of the carrier body in this configuration.

The electrically interconnected conductive elements may be assigned to a track that is axially bounded by webs.

Example embodiments of the present invention relate to a slip ring unit which includes a corresponding slip ring and a brush unit provided with a brush. The brush is able to contact the two conductive elements in a sliding manner across the first angular dimension in the respective first section of a conductive element, the first angular dimension extending across at least 270°.

For a slip ring having three conductive elements, the slip ring unit may be configured such that the brush is able to slidingly contact at least two conductive elements in the first section of the respective conductive element across the entire circumference.

The brush may be made of a metal-containing material, e.g., from a material that contains no carbon.

The brush may have a surface that includes noble metal, such as gold.

The slip ring unit may be arranged such that a conductive element is able to be contacted by the brush in dual fashion. The brush may have two free ends, each resting at one and the same conductive element at an offset in the circumferential direction. This arrangement is referred to as a double brush, which provides redundancy of the current or data transmission, for example.

The conductive elements that form a track may be axially surrounded by webs in the first section, the webs having a greater outer diameter than the first section of the conductive elements in order to limit the axial mobility of the brush.

The slip ring unit is used for the transmission of electrical power and/or electrical signals, e.g., for transmitting information.

Based on the configuration of the slip ring and/or the slip ring unit described herein, high frequency signals are able to be transmitted in a relatively uncomplicated manner. The configuration of the slip ring is also considered advantageous in view of a reduced electric capacity.

Further features and aspects of example embodiments of the present invention are described in more detail below with reference to the appended Figures.

DETAILED DESCRIPTION

Figure 1:
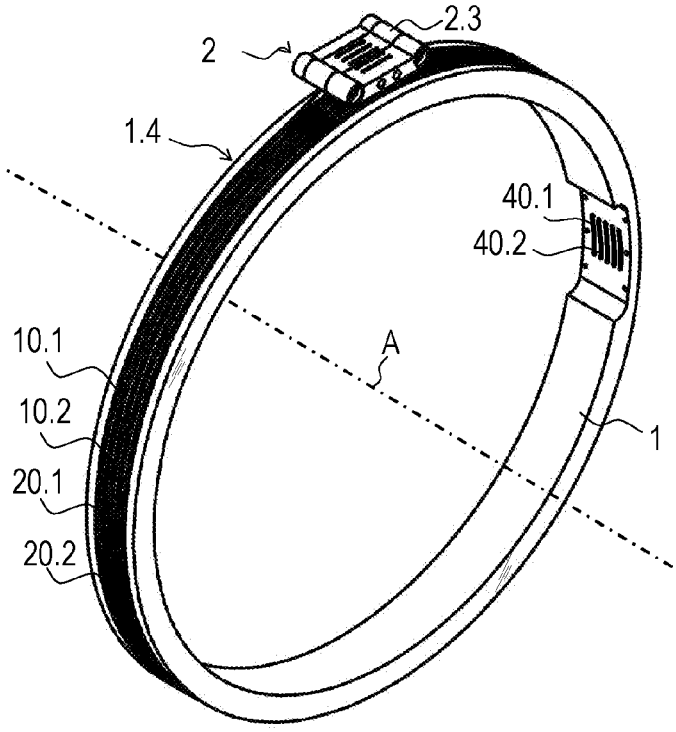
FIG. 1 is a perspective view of a slip ring unit.
Figure 2:
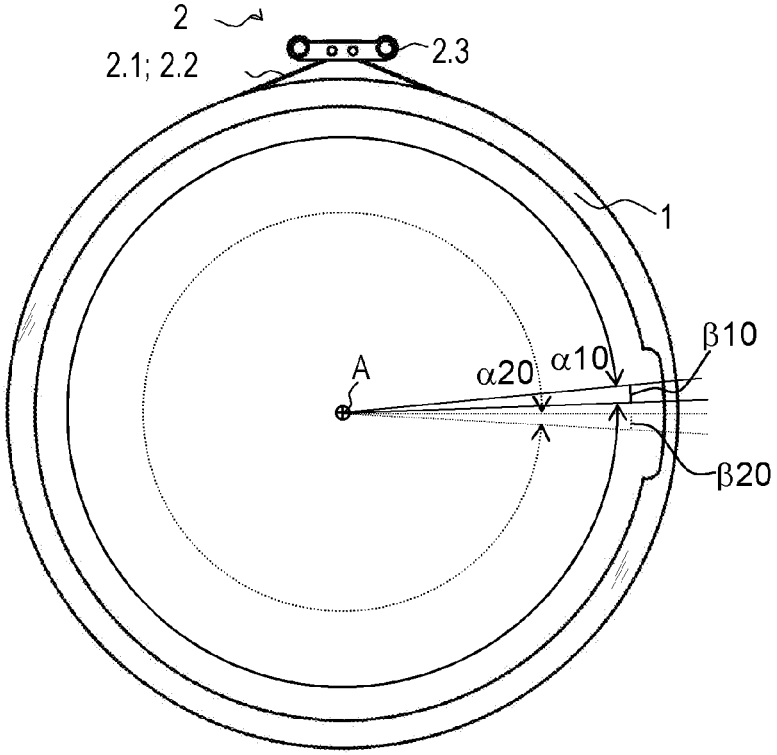
FIG. 2 is a side view of the slip ring unit.

FIGS. 1 and 2 illustrate a slip ring unit including a dielectric carrier body 1, which is substantially ring-shaped, and a brush unit 2. Although the slip ring unit may have a total of, e.g., five tracks or channels for transmitting five different currents or signals, only two tracks or channels are discussed below. Accordingly, the other tracks or channels have not been provided with reference numerals.

Conductive elements 10.1, 20.1, 10.2, 20.2 are provided on carrier body 1 or its lateral surface 1.4. Conductive elements 10.1, 20.1 may be assigned to a first track, and conductive elements 10.2, 20.2 may be assigned to a second track. Brush unit 2 has multiple electrically conductive brushes 2.1, 2.2, which are fixed in place on a brush holder 2.3. In the exemplary embodiment illustrated, brushes 2.1, 2.2 are arranged as wires, e.g., wires having a round cross section, which may be coated with gold. First brush 2.1 is associated with the first track, and second brush 2.2 is associated with the second track.

The slip ring unit is arranged such that a current transmission, e.g., a signal transmission, is possible between conductive elements 10.1, 20.1, 10.2, 20.2 and brushes 2.1, 2.2 when carrier body 1 or conductive elements 10.1, 20.1, 10.2, 20.2 execute(s) a relative rotation about an axis A. For example, a conductive element 10.1, 20.1, 10.2, 20.2 is contacted twice by a brush 2.1, 2.2, since each brush 2.1, 2.2 has two areas having a free end in each case (double-brush configuration). The ends are radially mobile within the elasticity limits of brush 2.1, 2.2.

Figure 3:
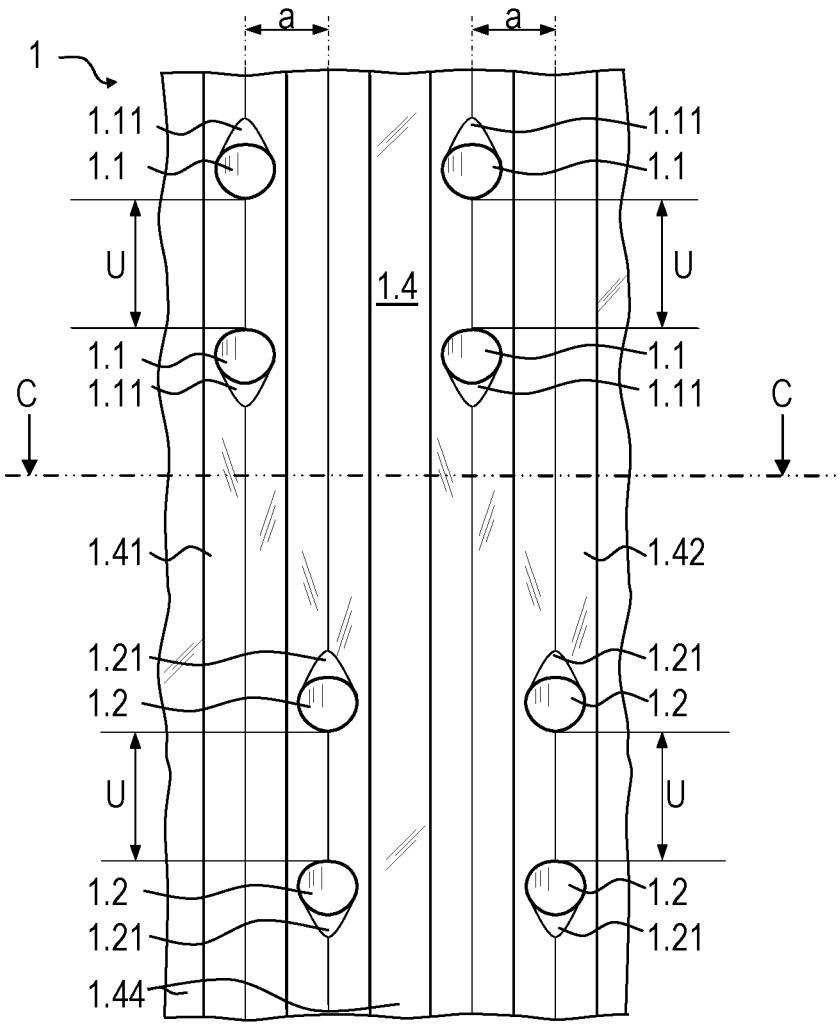
FIG. 3 is an enlarged view of the lateral surface of the slip ring without conductive elements.
Figure 4:
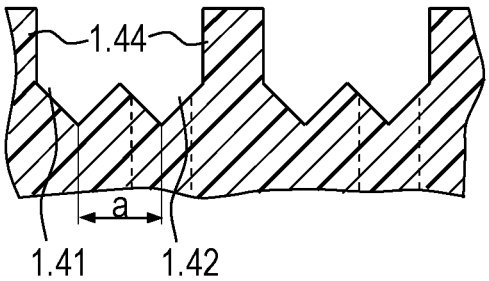
FIG. 4 is a cross-sectional view of the carrier body of the slip ring without conductive elements.

Grooves 1.41, 1.42 are provided in circumferential lateral surface 1.4 of carrier body 1, which are arranged, for example, as circumferential v-shaped grooves 1.41, 1.42 (see, e.g., FIGS. 3 and 4). Two grooves 1.41, 1.42, for example, are provided for one track or one transmission channel in each case. The fillet lines of grooves 1.41, 1.42, i.e., the lines produced at the points where the two areas of a groove 1.41, 1.42 meet, are arranged at an axial clearance a. The fillet lines extend in a direction perpendicular to axis A in the circumferential direction. Webs 1.44 are arranged axially between a pair of grooves 1.41, 1.42.

As illustrated in FIG. 3, radially oriented feed-through leads 1.1, 1.2 or bores, which extend through lateral surface 1.4, are provided in carrier body 1, feed-through leads 1.1, 1.2 being disposed on one and the same circumferential line at a distance U. Feed-through leads 1.1, 1.2 have a recess 1.11, 1.21 in the region of the fillet lines.

Figure 5:
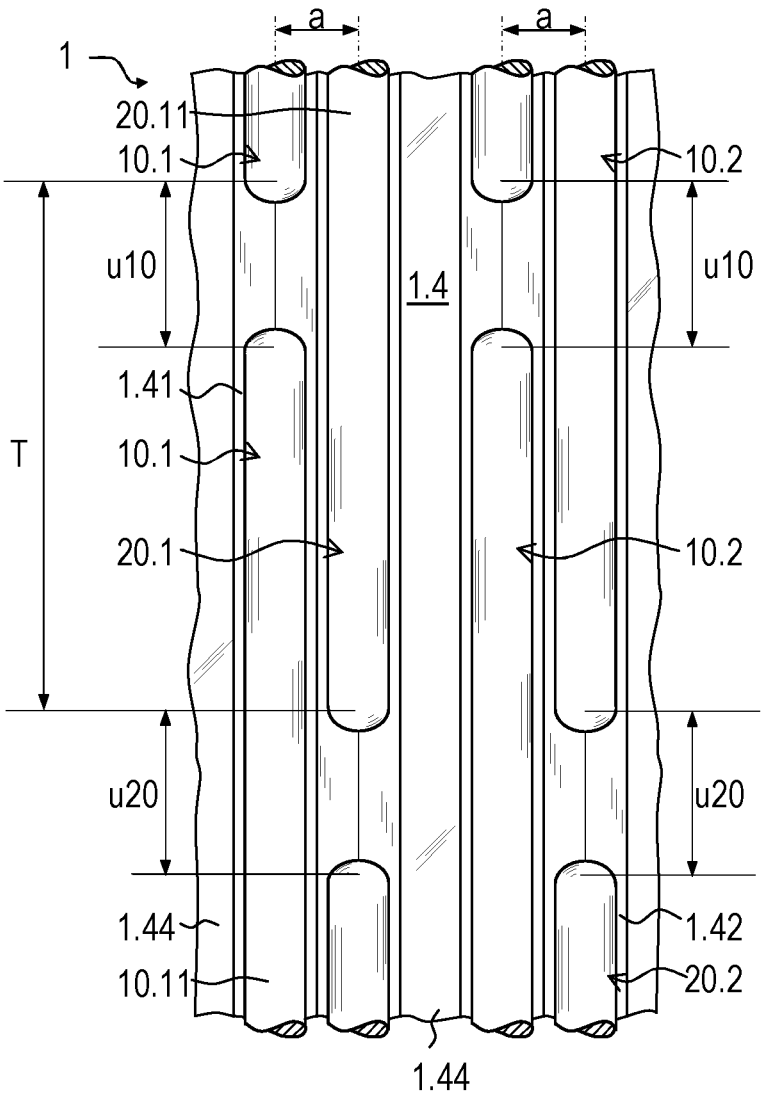
FIG. 5 is an enlarged view of the lateral surface of the slip ring with conductive elements.

FIG. 5 illustrates the section of the slip ring as FIG. 3, the only difference being that conductive elements 10.1, 20.1 of the first track and conductive elements 10.2, 20.2 of the second track are mounted on carrier body 1 in FIG. 5.

Figure 6:
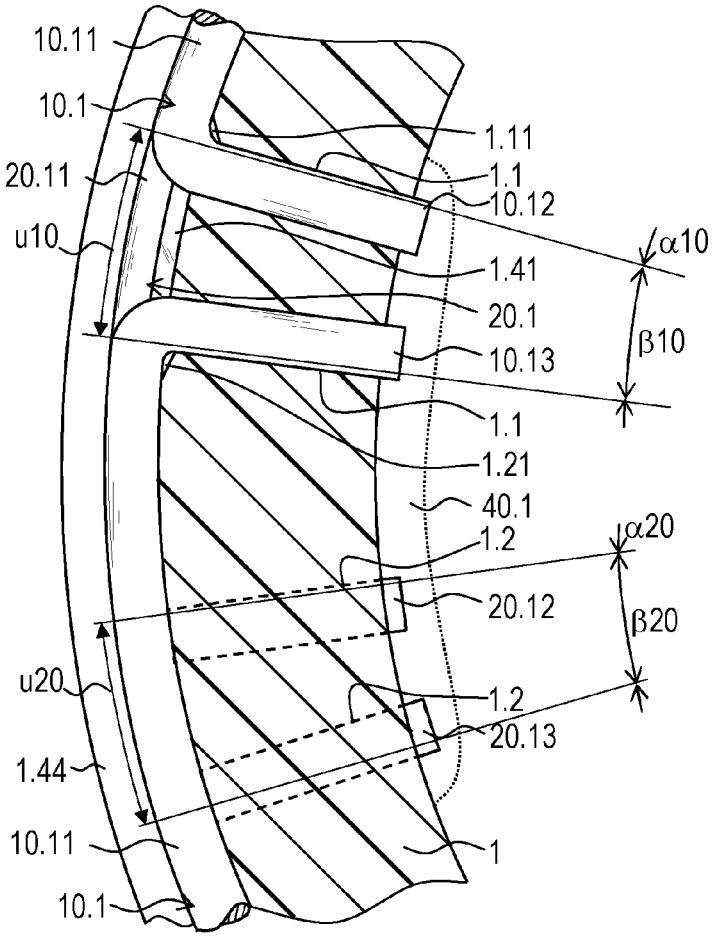
FIG. 6 is a cross-sectional view of the slip ring with conductive elements.

Hereinafter, the configuration of the slip ring will be explained with the aid of the first track. The material for conductive elements 10.1, 20.1 may be made available as coiled semifinished material, so that it is possible to manufacture the slip ring in a relatively cost-effective and economical manner. During this assembly, conductive elements 10.1, 20.1 are appropriately cut and bent, so that conductive elements 10.1, 20.1 have angled segments or second sections 10.12, 10.13, 20.12; 20.13 at their ends (see, e.g., FIG. 6).

Conductive elements 10.1, 20.1 prepared in this manner are placed inside grooves 1.41, 1.42. Second sections 10.12, 10.13, 20.12, 20.13 are inserted into feed-through leads 1.1, 1.2, so that second sections 10.12, 10.13, 20.12, 20.13, or their ends, project from carrier body 1 radially on the inside (see, e.g., FIG. 6). Each conductive element 10.1, 20.1 has a first section 10.1, 20.11, which extends in the individual groove 1.41, 1.42 in a circular manner about axis A in the circumferential direction, the radial outer contour of first sections 10.1, 20.11, for example, extending along a circular arc. Recesses 1.11, 1.21 provide for an accurate placement of conductive elements 10.1, 20.1 inside grooves 1.41, 1.42 in parallel at an axial offset a.

Once conductive elements 10.1, 20.1 have been fixed in place on carrier body 1 in this manner, second sections 10.12, 10.13, 20.12, 20.13 or the ends of conductive elements 10.1, 20.1 are connected to each other by soldering. In so doing, a first solder point 40.1 is created, which electrically and mechanically connects second sections 10.12, 10.13, 20.12, 20.13 to each other. Solder point 40.1 is indicated by a dotted line in FIG. 6. The two conductive elements 10.1, 20.1 of the first track (which thus are situated between two webs 1.44) are therefore at the same electrical potential as a consequence of the soldering of associated second sections 10.12, 10.13, 20.12, 20.13. In the later operation of the slip ring unit, the signal of a channel will be present at conductive elements 10.1, 20.1.

The other conductive elements 10.2, 20.2 are mounted in a similar manner.

Conductive elements 10.1, 20.1, 10.2, 20.2 are placed in grooves 1.41, 1.42 such that each of them extends around at a looping angle of less than 360°. In other words, first sections 10.11, 20.11 of conductive elements 10.1, 20.1 of the first track extend along a circumferential line across a first angular dimension $\alpha$10, $\alpha$20 of less than 360° (e.g., 355°). As a result, a discontinuity u10, u20, or a gap, is present along the circumferential direction of these conductive elements 10.1, 20.1 in a second angular dimension $\beta$10, $\beta$20. For example, second angular dimensions $\beta$10, $\beta$20 extend across an angle of 5°. In the exemplary embodiment illustrated, first angular dimension $\alpha$10, $\alpha$20 and second angular dimension $\beta$10, $\beta$20 add up to 360°. The following therefore applies:

$$\alpha 10+\beta 10=360°=\alpha 20+\mu 20.$$

Since feed-through leads 1.1, 1.2 are arranged such that second angular dimension $\beta$10 of first conductive element 10.1 is located at an offset from second angular dimension $\beta$20 of second conductive element 20.1 in the circumferential direction, a permanent contact of brush 1.1 of the first track with at least one of conductive elements 10.1, 20.1 of the first track is possible across one full rotation.

Because of the offset placement of feed-through leads 1.1, 1.2, conductive elements 10.1, 20.1, 10.2, 20.2 inside grooves 1.41, 1.42 extend such that the individual discontinuities u of a track are located at a mutual offset measure T in the circumferential direction. That is to say, each conductive element 10.1, 20.1 has a first section 10.1, 20.11, which extends in the form of a circular arc about axis A in the individual groove 1.41, 1.42, the radial outer contour of first sections 10.1, 20.11 (i.e., outside discontinuity u10, u20) in particular extending along a circular arc.

Figure 7:
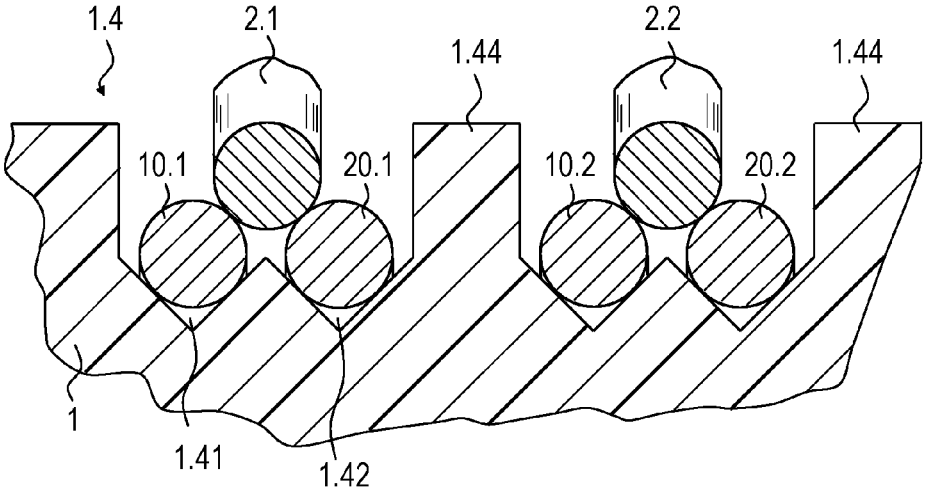
FIG. 7 is a cross-sectional view of the slip ring unit with conductive elements.

FIG. 7 is an enlarged view, where brushes 2.1, 2.2 are in sliding contact with conductive elements 10.1, 20.1 or 10.2, 20.2. Each brush 2.1, 2.2 is arranged in the form of a relatively elastic, electrically conductive metal wire, and the surfaces of brushes 2.1, 2.2 are gold-plated. A partial cross-section of brushes 2.1, 2.2 plunges between conductive elements 10.1, 20.1, 10.2, 20.2, so that brushes 2.1, 2.2 are unable to shift in the axial direction when the slip ring unit is in operation. In the first track, for example, brush 2.1 is in electrical contact with both conductive elements 10.1, 20.1 in first section 10.11 of conductive elements 10.1, 20.1.

The slip ring unit is used for the transmission of electrical signals, e.g., high frequency signals. The slip ring unit makes it possible to transmit high data rates for Ethernet links, Sercos data links, other real-time data links, etc. The configuration described herein ensures that brushes 2.1, 2.2 have permanent contact with conductive elements 10.1, 20.1, 10.2, 20.2. Furthermore, a relatively low electric capacitance in the transmission path may be achieved, which makes it possible to transmit even extremely high-frequency signals.

Figure 8:
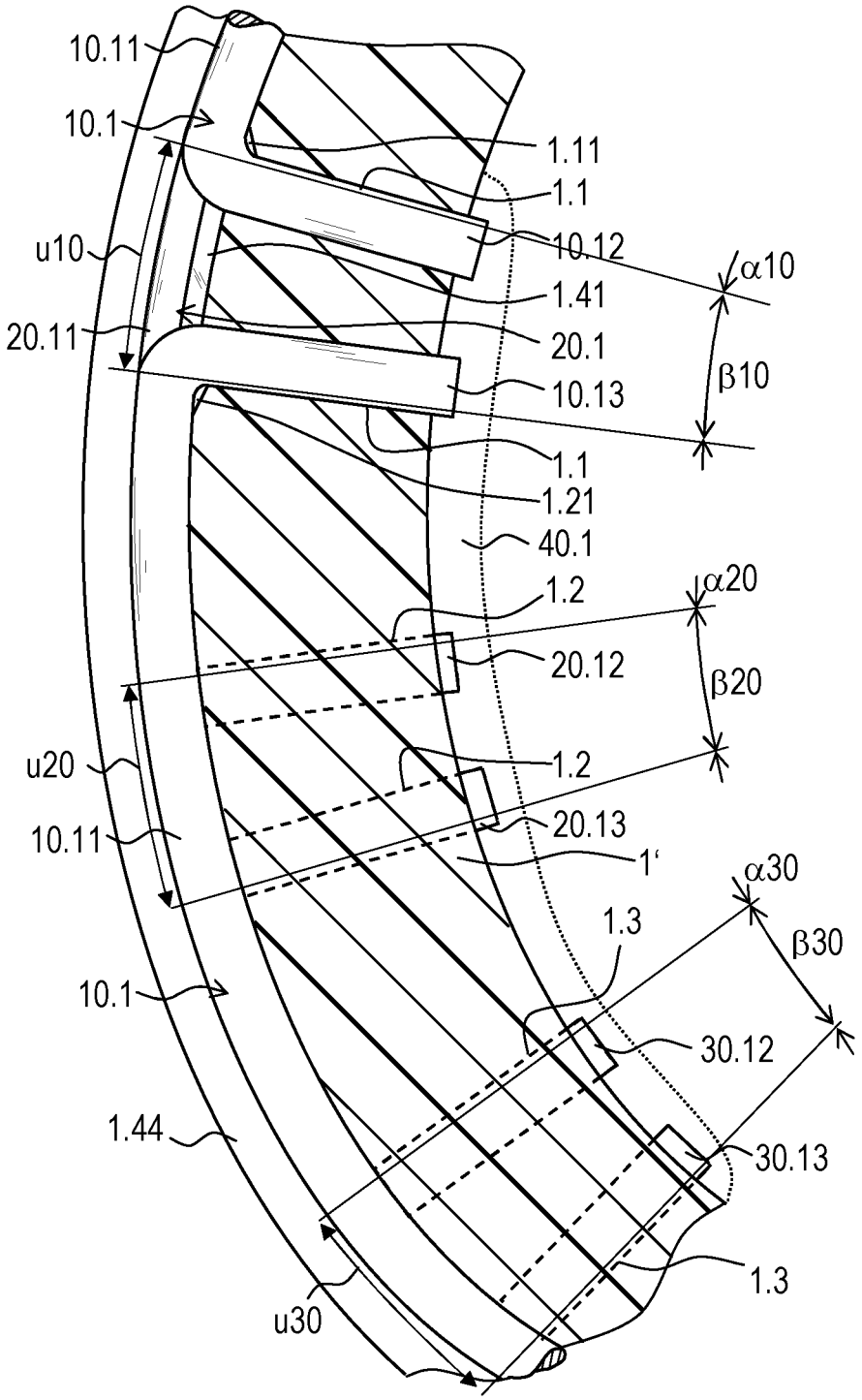
FIG. 8 is a cross-sectional view of a slip ring with conductive elements.
Figure 9:
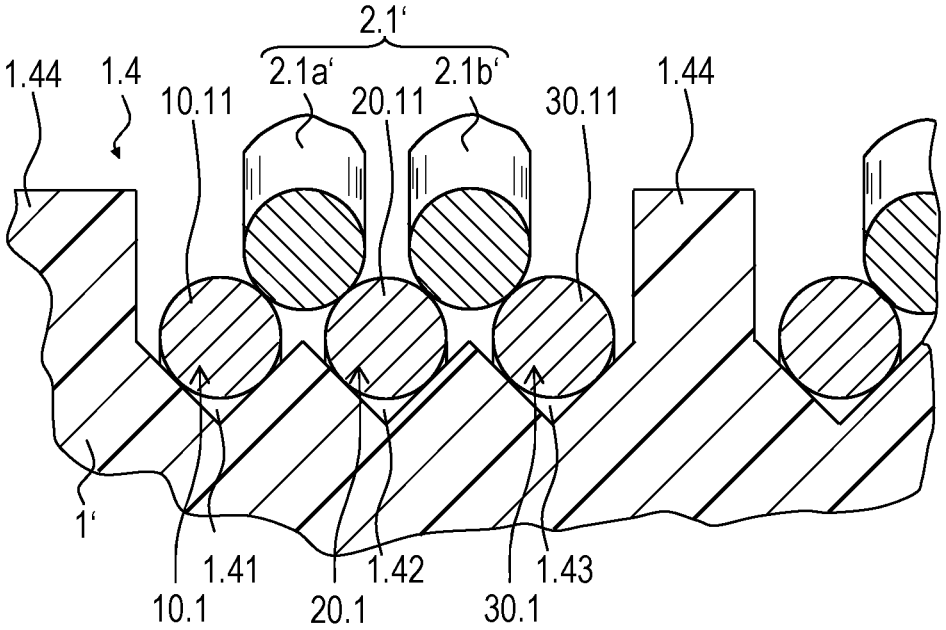
FIG. 9 is a cross-sectional view of the slip ring unit with conductive elements illustrated in FIG. 8.

According to an exemplary embodiment, as illustrated in FIGS. 8 and 9, the first track includes three grooves 1.41, 1.42, 1.43 in lateral surface 1.4 of carrier body 1'. Conductive elements 10.1, 20.1, 30.1 are mounted inside these grooves 1.41, 1.42, 1.43, in a similar manner as in the above-described exemplary embodiment. Conductive elements 10.1, 20.1, 30.1 are arranged in grooves 1.41, 1.42, 1.43, such that they rotate in a first angular dimension $\alpha$10, $\alpha$20, $\alpha$30 of less than 360°. As a result, there is a discontinuity u10, u20, u30, or a gap, at the outer circumference of individual conductive element 10.1, 20.1, 30.1 in a second angular dimension $\beta$10, $\beta$20, $\beta$30. Because of an offset placement of feed-through leads 1.1, 1.2, 1.3 in carrier body 1', conductive elements 10.1, 20.1, 30.1 extend inside grooves 1.41, 1.42, 1.43 such that the individual discontinuities u10, u20, u30 are arranged at a mutual offset in the circumferential direction.

The first track having conductive elements 10.1, 20.1, 30.1 is separated from an adjacent second track by a web 1.44. First brush 2.1' includes two brush elements 2.1*a*', 2.1*b*'. In the exemplary embodiment illustrated, brush elements 2.1*a*', 2.1*b*' are arranged as wires, e.g., wires having a round cross-section, which are, for example, coated with a noble metal, such as gold.

Figure 10:
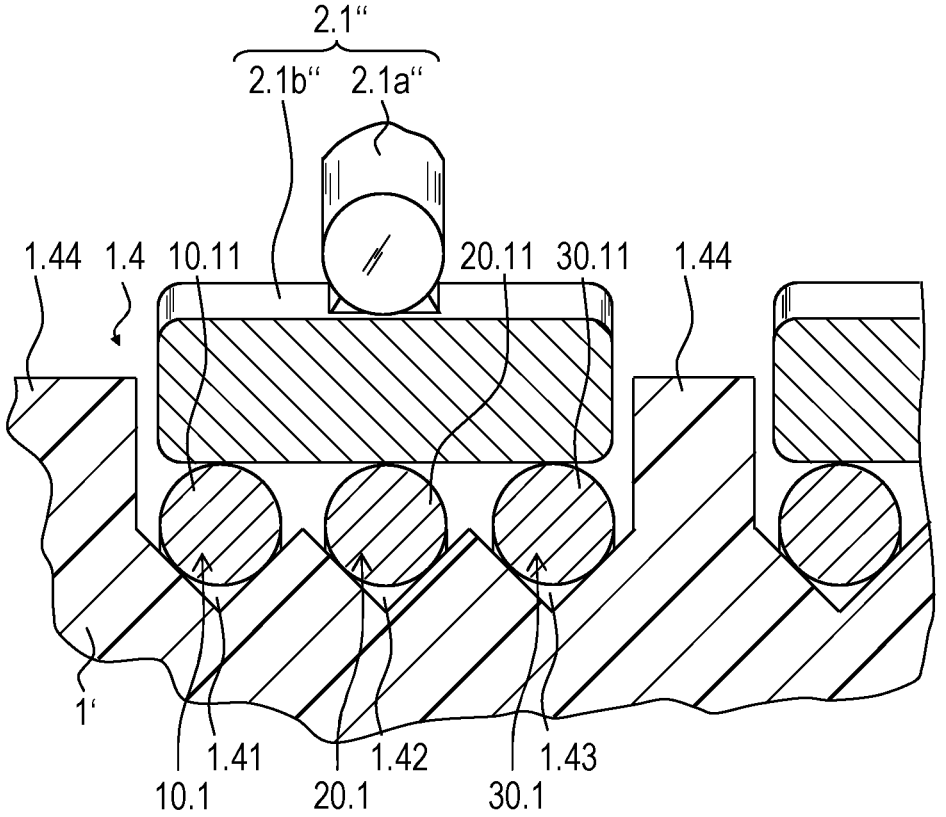
FIG. 10 is a cross-sectional view of a slip ring unit with conductive elements.

According to an exemplary embodiment, as illustrated in FIG. 10, the first track includes three grooves 1.41, 1.42, 1.43 in lateral surface 1.4 of carrier body 1". Conductive elements 10.1, 20.1, 30.1 are mounted in these grooves 1.41, 1.42, 1.43, in a similar manner as in the above-described exemplary embodiments.

The first track having conductive elements 10.1, 20.1, 30.1 is separated from an adjacent second track by a web 1.44. First brush 2.1" includes two brush elements 2.1*a*", 2.1*b*", which are connected to each other by a solder joint. In the exemplary embodiment illustrated, first brush element 2.1*a*" is arranged as a wire having a round cross-section, for example. Second brush element 2.1*b*" is fixed in place on this first brush element 2.1*a*". It has a substantially block-shaped configuration and is made of silver-graphite, for example. When the slip ring unit is in operation, first brush element 2.1*a*" is used for transmitting currents or signals, and for radially tensioning second brush element 2.1*b*" with respect to conductive elements 10.1, 20.1, 30.1. Moreover, webs 1.44 ensure that the movement of second brush element 2.1*b*" is limited in the axial direction.

What is claimed is:

1. A slip ring, comprising:

a dielectric carrier body having a circumferential lateral surface and radially oriented feed-through leads that extend through the lateral surface;

a first conductive element; and a second conductive element;

wherein the first and second conductive elements are arranged on the lateral surface in parallel at an axial offset, extend in a circumferential direction in a first section, and extend in the feed-through leads with a radial directional component in a second section;

wherein the first section of each of the first and second conductive elements extends across a first angular dimension of less than 360° in the circumferential direction so that a discontinuity is present along the circumferential direction of the first and second conductive elements in a second angular dimension;

wherein the feed-through leads are arranged such that the second angular dimension of the first conductive element is situated at an offset from the second angular dimension of the second conductive element in the circumferential direction; and wherein the first conductive element and the second conductive element are electrically connected to each other.

2. The slip ring according to claim 1, wherein the lateral surface includes a first circumferential groove and a second circumferential groove, the first conductive element being arranged in the first groove, the second conductive element being arranged in the second groove.

3. The slip ring according to claim 1, further comprising a third conductive element arranged in a first section on the lateral surface in parallel with and at an axial offset from the first conductive element and the second conductive element, the third conductive element extending in the circumferential direction and extending in a second section in feed-through leads with a radial directional component, the first section of the third conductive element extending across a first angular dimension of less than 360° such that a discontinuity is present along the circumferential direction of the third conductive element in a second angular dimension;

wherein the feed-through leads are arranged such that the second angular dimension of the third conductive element is disposed at an offset from the second angular dimension of the first conductive element and/or the second conductive element in the circumferential direction, the first conductive element, the second conductive element, and the third conductive element being electrically connected to each other.

4. The slip ring according to claim 1, wherein a clearance is arranged between the feed-through lead of the first conductive element and the feed-through lead of the second conductive element in the circumferential direction.

5. The slip ring according to claim 1, wherein each of the first and second conductive elements includes a wire.

6. The slip ring according to claim 5, wherein the wire has a cross-section of less than 20 $mm^2$.

7. The slip ring according to claim 1, wherein each conductive element is a one-piece conductive element.

8. The slip ring according to claim 1, wherein an electrical connection of the first and second conductive elements is located radially inside relative to the first section.

9. The slip ring according to claim 1, wherein the electrically interconnected first and second conductive elements are allocated to a track axially bounded by webs.

10. A slip ring unit, comprising:

a slip ring including:

a dielectric carrier body having a circumferential lateral surface and radially oriented feed-through leads that extend through the lateral surface;

a first conductive element; and a second conductive element;

wherein the first and second conductive elements are arranged on the lateral surface in parallel at an axial offset, extend in a circumferential direction in a first section, and extend in the feed-through leads with a radial directional component in a second section;

wherein the first section of each of the first and second conductive elements extends across a first angular dimension of less than 360° in the circumferential direction so that a discontinuity is present along the circumferential direction of the first and second conductive elements in a second angular dimension;

wherein the feed-through leads are arranged such that the second angular dimension of the first conductive element is situated at an offset from the second angular dimension of the second conductive element in the circumferential direction; and wherein the first conductive element and the second conductive element are electrically connected to each other; and a brush unit including a brush, the brush being in sliding contact with the first and second conductive elements in the first section across the first angular dimension, the first angular dimension amounting to at least 270°.

11. The slip ring unit according to claim 10, wherein the slip ring includes a third conductive element arranged in a first section on the lateral surface in parallel with and at an axial offset from the first conductive element and the second conductive element, the third conductive element extending in the circumferential direction and extending in a second section in feed-through leads with a radial directional component, the first section of the third conductive element extending across a first angular dimension of less than 360° such that a discontinuity is present along the circumferential direction of the third conductive element in a second angular dimension;

wherein the feed-through leads are arranged such that the second angular dimension of the third conductive element is disposed at an offset from the second angular dimension of the first conductive element and/or the second conductive element in the circumferential direction, the first conductive element, the second conductive element, and the third conductive element being electrically connected to each other; and wherein the brush is in sliding contact with at least two conductive elements in the first section across the entire circumference.

12. The slip ring unit according to claim 10, wherein the brush is formed of a metal-containing material.

13. The slip ring unit according to claim 10, wherein the brush includes a surface containing a noble metal.

14. The slip ring unit according to claim 10, wherein at least one conductive element is doubly contactable by the brush.

15. The slip ring unit according to claim 10, wherein the first and second conductive elements are axially surrounded by webs in the first section to restrict the axial movement of the brush.

* * * * *